US007051684B2

(12) United States Patent
Bauer

(10) Patent No.: US 7,051,684 B2
(45) Date of Patent: May 30, 2006

(54) OIL INLET FOR AN INTERNAL COMBUSTION ENGINE PISTON THAT IS PROVIDED WITH A COOLING DUCT

(75) Inventor: Valery Bauer, Walblingen (DE)

(73) Assignee: MAHLE GmbH, Stuttgart (DE)

( * ) Notice: Subject to any disclaimer, the term of this patent is extended or adjusted under 35 U.S.C. 154(b) by 0 days.

(21) Appl. No.: 10/509,663

(22) PCT Filed: Apr. 2, 2003

(86) PCT No.: PCT/DE03/01076

§ 371 (c)(1),
(2), (4) Date: Sep. 29, 2004

(87) PCT Pub. No.: WO03/085251

PCT Pub. Date: Oct. 16, 2003

(65) Prior Publication Data

US 2005/0115523 A1 Jun. 2, 2005

(30) Foreign Application Priority Data

Apr. 4, 2002 (DE) ..... 102 14 830

(51) Int. Cl.
*F01D 1/04* (2006.01)

(52) U.S. Cl. ..... 123/41.35

(58) Field of Classification Search ..... 123/41.35; 137/801

See application file for complete search history.

(56) References Cited

U.S. PATENT DOCUMENTS 3,221,718 A 12/1965 Isley
5,881,684 A * 3/1999 Bontaz ..... 123/41.35
5,917,418 A * 6/1999 Han ..... 340/686.2
6,494,170 B1 * 12/2002 Moloney et al. ..... 123/41.35
6,494,387 B1 * 12/2002 Kaneko ..... 239/296
6,532,912 B1 * 3/2003 Moller et al. ..... 123/41.35
6,672,261 B1 * 1/2004 Svensson ..... 123/41.35
6,672,262 B1 * 1/2004 Bontaz ..... 123/41.35
6,701,875 B1 * 3/2004 Weng et al. ..... 123/41.35

FOREIGN PATENT DOCUMENTS

| | | |
|---|---|---|
| AT | 0 01 919 | 1/1998 |
| DE | 37 33 964 | 4/1989 |
| DE | 40 39 752 | 6/1992 |
| DE | 199 27 931 | 1/2001 |
| EP | 11 99 461 | 4/2002 |
| FR | 20 79 873 | 11/1971 |
| FR | 21 25 687 | 9/1972 |
| JP | 59 27109 | 2/1984 |
| JP | 59 27119 | 2/1984 |
| WO | PCT/DE94/01375 | 6/1995 |
| WO | WO 0144645 | 6/2001 |

* cited by examiner

*Primary Examiner*—Henry C. Yuen
*Assistant Examiner*—Jason Benton
(74) *Attorney, Agent, or Firm*—Collard & Roe, P.C.

(57) ABSTRACT

An oil inlet (2) for a piston (1) provided with a cooling duct (4) and installed in an internal combustion engine is designed in order to enable an improved concentration of a cooling oil stream when entering the oil inlet and an improved distribution when exiting into the cooling duct. To this end, the inner wall surface (3) of the oil inlet (2) is shaped according to a function of a one-sheeted rotating hyperboloid or of a surface-delimited torus, whereby the shape is determined according to a stream position of the cooling oil stream (7), which is produced by an oil spraying nozzle (6), relative to the cross sectional opening area (B, D) of the oil inlet.

4 Claims, 1 Drawing Sheet

Figure 1:
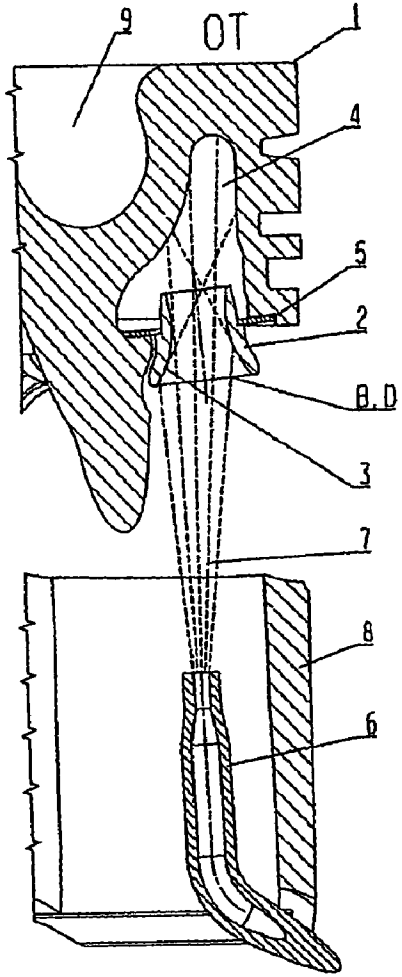

OIL INLET FOR AN INTERNAL COMBUSTION ENGINE PISTON THAT IS PROVIDED WITH A COOLING DUCT

CROSS REFERENCE TO RELATED APPLICATIONS

Applicant claim priority under 35 U.S.C. §119 of German Application No. 102 14 830.9 filed on Apr. 4, 2002. Applicant also claims priority under 35 U.S.C. §365 of PCT/DE03/01076 filed on Apr. 2, 2003. The international application under PCT article 21(2) was not published in English.

The invention relates to an oil inlet for an internal combustion engine piston that is provided with a cooling duct, having an approximately circular cover of the cooling duct, to which the oil inlet is attached, and the cooling duct can have a free cooling oil stream applied to it by way of the oil inlet, by means of an oil spraying nozzle rigidly connected with the engine housing, from the crank space, through the free interior of the piston shaft.

Such cooled pistons having an oil inlet are known, for example, from the patents U.S. Pat. Nos. 3,221,718, JP 59-27119, PCT/DE94/01375, and DE 37 33 964 C2. The oil inlets used as catch funnels for cooling oil that is dispensed from an oil spraying nozzle connected with the engine housing have inner walls that are configured to be funnel-shaped, cylindrical, oval, or in the form of a Venturi jet, viewed from the free interior of the piston, in the direction of the cooling duct. In order to achieve better distribution, in the cooling duct, of the cooling oil captured in this manner, additional stream dividers are inserted into the wall of the cooling duct, which lie opposite the exit surface of the oil inlet.

Using such shaping structures, the result is supposed to be achieved that the oil stream that widens from the oil spraying nozzle is captured and passed to the cooling duct, whereby these embodiments are not limited only to vertical oil stream systems, i.e. perpendicular to the entry surface of the oil inlet, but also comprise slanted oil stream positions, in which the amount of oil that reaches the cooling duct is determined as a function of the stroke height of the piston. In particular, the embodiment last mentioned demonstrates defects in achieving a continuous oil fill level of the cooling duct, due to disadvantageous flow and friction conditions during entry of the cooling oil into the inlet.

In practice, measurements of the actual oil fill level in the cooling duct have shown that with the oil inlets shaped as described above as catch funnels, the fill level is less than 40% and therefore, as described in DE 37 02 272 C2, sufficient cooling of the piston cannot be achieved by means of a Shaker effect. In particular, a very definite amount of oil circulating in the cooling duct is required for a good cooling effect, and this amount must be supplied continuously, in order to allow an approximately constant partial fill of the cooling duct, with an outflow of oil that is appropriately coordinated with the oil inlet.

Proceeding from this, the invention is based on the task of structuring an oil inlet for a piston having a cooling duct, in such a manner that better bundling of the cooling oil stream at the entry into the oil inlet, and better distribution at the exit into the cooling duct, is made possible.

This task is accomplished by means of the characteristics of claim 1.

The solution according to the invention makes it possible to introduce a free cooling oil stream having an approximately perpendicular impact on the cross sectional opening area of the oil inlet completely into the cooling duct. In the case of a slanted stream position of the free cooling oil stream, the result is advantageously achieved that the major portion is introduced into the cooling duct, since as a result of a tangential deflection of the oil stream that impacts on the wall of the inlet, a lower friction resistance occurs. Cooling oil streams directed at a slant are used in engines in which the oil spraying nozzle must be arranged at a certain angle to the area normal of the cross sectional opening area of the inlet, i.e. to the longitudinal axis of the piston, for design reasons. Because of the slanted orientation of the cooling oil stream, it impacts the inner wall of the inlet at different locations, in each instance, due to the stroke movement of the piston.

Despite these conditions, optimal bundling at the entry and very good distribution at the exit of the cooling oil from the inlet is achieved, both with a slanted stream position and a perpendicular stream position. A supporting factor here is that because of the size and shaping of the inlet, a dynamic compression pressure is generated, for improved cooling oil distribution.

Advantageous further developments are the object of the dependent claims.

Figure 2:
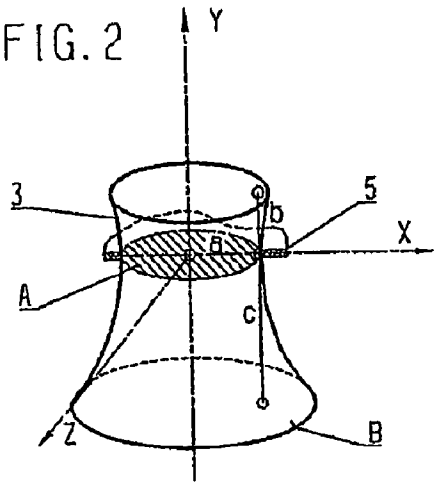
Figure 3:
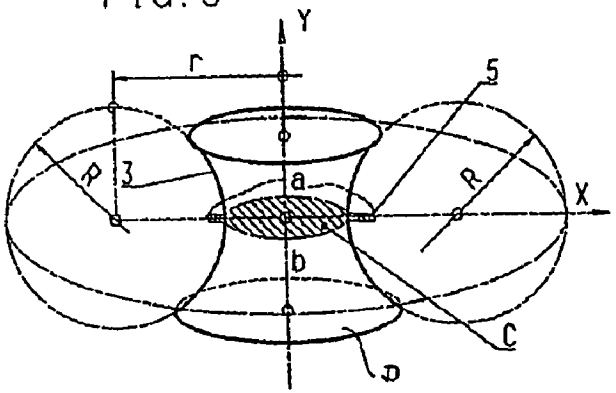

The invention will be explained, in the following, using an exemplary embodiment. The drawing shows:

FIG. 1 a piston according to the invention in partial cross-section, cut in the direction of the pin;

FIG. 2 a representation of the inner wall surface in a first exemplary embodiment;

FIG. 3 a representation of the inner wall surface in a second exemplary embodiment.

A piston 1 having a combustion depression 9 has a cooling duct 4 that is closed off towards the bottom by means of a cover 5 in the form of a two-part cup spring. An oil inlet 2 is provided in the cover 5, configured as a catch funnel for a cooling oil stream 7; this inlet can consist of metal or plastic and can be attached, forming an oil seal, by means of soldering, welding, gluing, or by means of a locking ring, a bracing element, or an engagement connection on the cooling duct cover, as known from DE 199 60 913 A1. The cooling duct 4 is supplied with the free cooling oil stream 7, as shown in FIG. 1, by way of the oil inlet 2, by means of an oil spraying nozzle 6 rigidly connected with the engine housing, from the crank space through the free interior of the piston shaft, whereby the cross sectional entry areas B, or, according to FIG. 3, D, serve as the oil entry.

The oil inlet 2 possesses an inner wall 3, the shape of which is determined as a function of the stream position of the cooling oil stream 7 with reference to the cross sectional entry area B and D of the oil inlet, produced by the oil spraying nozzle 6. In the case of an approximately perpendicular stream position of the cooling oil stream relative to the cross sectional opening area B, corresponding to the representation in FIG. 1, the inner wall surface 2 of the oil inlet 3 has a shape that is formed in the right-angle coordinate system (x, y, z) by means of rotation of the hyperbolic function $y=\pm b/a*\sqrt{x^2-a^2}$ about its y axes, whereby a=6 mm, b=5 mm, and the cross sectional entry area B is formed by a parallel cut at the distance $y_B=c=8$ mm relative to the x axis. In another exemplary embodiment, a=b=5 mm can also apply.

In the case of a slanted position of the free cooling stream 7, the inner wall surface of the oil inlet, with a stream that lies within the cross sectional entry area D in every stroke position of the piston, is configured in the shape of a toroid that is formed in the right-angle coordinate system (x, y, z) at a distance r=20 mm from the y axis, by means of rotation of a circle having the radius R=13 mm about the y axis, which is parallel to the circle area and does not intersect the circle. The total height h=a+b of the oil inlet is 12 mm, whereby a=b, the two-part cup spring 5 is therefore arranged at the level of the smallest cross sectional area C. In another exemplary embodiment, a=5 and b=6 mm can also apply, so that the oil entry area D and the oil supply for a specific time cross section, as described below, reaches its maximum value.

The dimensions of the oil inlet guarantee that the volume from the cross sectional entry areas B and D to the cross sectional areas A and B is so great that the oil supply for the time cross section of 0 to 360 crank angles fits into the oil inlet. Furthermore, the cross sectional area A determined by the function constant a approximately corresponds to the oil stream cross section at the upper dead center OT of the piston, whereby a very effective oil distribution at the exit into the cooling duct is achieved by means of the aforementioned measures.

The cross sectional areas A, C of the oil inlet 3, in other words the smallest cross sectional areas of the oil inlet 2, are arranged approximately in the plane of the circular cover 5 of the cooling duct 4, so that an excess level is formed in the interior of the cooling duct, which leaves a defined partial amount of cooling oil in the cooling duct for circulation until overflow, with reference to the size of the outlet (excess level and size of the outflow opening—not shown).

The production of the oil inlets 2 takes place as a lathed part, by means of a computer-controlled program.

REFERENCE SYMBOLS

Piston 1
Oil inlet 2
Inner wall of the oil inlet 3
Cooling duct 4
Cover 5
Oil spraying nozzle 6
Oil stream 7
Cylinder 8
Combustion depression 9
Cross sectional area A, C
Cross sectional entry area B, D
Upper dead center OT

The invention claimed is:

1. Oil inlet for an internal combustion engine piston that is provided with a cooling duct, having an approximately circular cover of the cooling duct, to which the oil inlet is attached, and the cooling duct can have a free cooling oil stream applied to it by way of the oil inlet, by means of an oil spraying nozzle rigidly connected with the engine housing, from the crank space, through the free interior of the piston shaft, wherein the inner wall surface of the oil inlet is shaped according to a function of a one-sheeted rotating hyperboloid or of a surface-delimited torus, whereby the shape is determined as a function of the stream position of the cooling oil stream produced by the oil spraying nozzle, with reference to the cross sectional entry area of the oil inlet, and wherein in the case of an approximately perpendicular stream position of the cooling oil stream relative to the cross sectional opening area, the inner wall surface of the oil inlet has a shape that is formed in the right-angle coordinate system by means of rotation of the hyperbolic function $y=\pm.b/a$ times the square root of $x^2$ minus $a^2$ about its y axes, whereby a=6 mm, b=5 mm, and the cross sectional entry area (B) is formed by a parallel cut at the distance $y_g$=c=8 mm relative to the x axis.

2. Oil inlet as recited in claim 1, wherein the cross sectional areas of the oil inlet are arranged approximately in the plane of the circular cover of the cooling duct.

3. Oil inlet as recited in claim 1, wherein the cross sectional area determined by the function constant a approximately corresponds to the oil stream cross section at the upper dead center of the piston.

4. Oil inlet for an internal combustion engine piston that is provided with a cooling duct, having an approximately circular cover of the cooling duct, to which the oil inlet is attached, and the cooling duct can have a free cooling oil stream applied to it by way of the oil inlet, by means of an oil spraying nozzle rigidly connected with the engine housing, from the crank space, through the tree interior of the piston shaft, wherein the inner wall surface of the oil inlet is shaped according to a function of a one-sheeted rotating hyperboloid or of a surface-delimited torus, whereby the shape is determined as a function of the stream position of the cooling oil stream produced by the oil spraying nozzle, with reference to the cross sectional entry area of the oil inlet, and wherein in the case of a slanted position of the free cooling stream, the inner wall surface of the oil inlet, with a stream that lies within the cross sectional entry area of the oil inlet in every stroke position of the piston, is configured in the shape of a toroid that is formed in the right-angle coordinate system at a distance r=20 mm from the y axis, by means of rotation of a circle having the radius R about the y axis, which is parallel to the circle area and does not intersect the circle, whereby r=20 mm, R=13 mm, and the total height h of the oil inlet is 12 mm.

* * * * *